US011932366B1

(12) United States Patent
Nyren

(10) Patent No.: US 11,932,366 B1
(45) Date of Patent: Mar. 19, 2024

(54) PONTOON KICKER MOTOR MOUNT

(71) Applicant: Powrtran INC., St. Cloud, MN (US)

(72) Inventor: Gary Nyren, St. Augusta, MN (US)

(73) Assignee: Powrtran Inc., St. Cloud, MN (US)

( * ) Notice: Subject to any disclaimer, the term of this patent is extended or adjusted under 35 U.S.C. 154(b) by 221 days.

(21) Appl. No.: 17/220,663

(22) Filed: Apr. 1, 2021

Related U.S. Application Data

(60) Provisional application No. 63/003,639, filed on Apr. 1, 2020.

(51) Int. Cl.
*B63H 20/06* (2006.01)
*B63B 3/48* (2006.01)
*B63B 35/34* (2006.01)

(52) U.S. Cl.
CPC ..... *B63H 20/06* (2013.01); *B63B 3/48* (2013.01); *B63B 35/34* (2013.01)

(58) Field of Classification Search
CPC ..... B63H 20/06; B63B 3/48; B63B 35/34
See application file for complete search history.

(56) References Cited

U.S. PATENT DOCUMENTS 3,604,674 A * 9/1971 Wilkerson ..... B63H 20/06 248/642
D274,908 S 7/1984 Ferguson et al.
D291,277 S 8/1987 Hawkins et al.
D292,391 S 10/1987 Schlesch
4,889,507 A 12/1989 Tahara et al.
5,679,036 A * 10/1997 Crawley ..... B63H 20/06 114/347
5,782,662 A 7/1998 Icenogle
6,132,271 A 10/2000 Hebert
7,410,400 B2 8/2008 Staudinger
D611,887 S 3/2010 Peschmann
8,267,025 B2 9/2012 Witte
8,535,105 B1 9/2013 Pelini
8,627,779 B2 1/2014 Witte
8,657,637 B1 2/2014 Pelini
8,882,551 B1 11/2014 Quail
9,022,342 B2 * 5/2015 Witte ..... B63H 20/06 248/641

(Continued)

FOREIGN PATENT DOCUMENTS

WO WO-03064251 A1 * 8/2003 ..... B63H 20/06

*Primary Examiner* — Stephen P Avila
(74) *Attorney, Agent, or Firm* — Christensen, Fonder, Dardi & Herbert PLLC; Douglas J. Christensen

(57) ABSTRACT

In embodiments, the kicker mount system comprises a deck mount unit connected to a kicker motor receiving unit, both cantilevered off of the stern end of pontoon boat deck. The deck having a horizontal deck pad and trim rail about the deck pad. The kicker mount system attaches exclusively to the deck on the deck pad and on the trim rail without any additional support structure securing the kicker mount system to the pontoon boat. The kicker motor receiving unit is vertically adjustably attached to the deck mount unit. The deck mount unit having an L-shaped pontoon deck plate with a horizontal portion that attaches to the deck top surface, and a vertical portion that attaches with a toggle bolt into the trim rail. Upright cantilevered extension plates project rearward from the L-shaped deck plate, the extension plates having a hump portion projecting upwardly above the deck plate.

18 Claims, 9 Drawing Sheets

(56) References Cited

U.S. PATENT DOCUMENTS

| | | | |
|---|---|---|---|
| 9,598,159 | B2 | 3/2017 | Nyren |
| 2003/0032344 | A1 | 2/2003 | Blanchard |
| 2010/0127150 | A1 | 5/2010 | Wakeham |

* cited by examiner

PONTOON KICKER MOTOR MOUNT

CROSS-REFERENCE TO RELATED APPLICATIONS

The present application claims the benefit of U.S. Provisional Patent Application No. 63/003,639, filed Apr. 1, 2020.

FIELD OF THE INVENTION

The present invention relates to accessories for boats and outboard motors. More particularly, it relates to outboard motor mounts for pontoon boats.

BACKGROUND

Kicker motors, sometimes referred to as a spare outboard motor or a trolling motor, are typically mounted to the side of a main, larger outboard motor. Kicker motors serve a number of useful functions beyond merely being a backup in the event of main engine failure. Kicker motors are generally quieter than main outboard motors. Kicker motors may be generally better suited for activities than a main outboard motor such as maintaining a position or gently propelling a boat through water, particularly when fishing. Such activities are often enjoyed on pontoon boats. Pontoon boats typically have a flat deck atop two or more pontoon hull structures. The flat deck is typically made of plywood and has outer trim attached to the edge and extending entirely around the perimeter of the deck. A prior art kicker motor mount for a pontoon boat is illustrated in U.S. Pat. No. 9,022,342 illustrating the kicker motor mounted behind a pontoon.

SUMMARY OF THE INVENTION

The shape of the transom on pontoon boats makes it difficult to easily and securely attach a secondary motor. Further, as maintaining the integrity of the pontoon hull structures is critical to keeping a pontoon boat afloat, it is generally unwise to mount anything to the hull structure, particularly using fasteners which could penetrate the structure and impact floatability. Further yet, the round, tubular structure of the two or more pontoon hull structures in close proximity to the flat deck atop the hull structures creates very small and hard to reach spaces making it difficult to securely attach items to the transom and/or decking of a pontoon boat. A mounting system that can attach a kicker motor to a pontoon boat without the need to get underneath the boat or use specialized tools, and further without compromising the integrity of the pontoon hull structures, would be well received by the industry. The device of the present application substantially meets the aforementioned needs of the industry. The kicker motor mounting system provides a mechanism easily secured to a pontoon boat using standard tools and minimizing or eliminating the need to go under the boat or access tight spaces.

The flat deck in conventional pontoon boats is typically made of plywood deck pad and has an outer trim configured as a rail attached to an edge of the plywood deck pad and extending entirely around the perimeter of the plywood deck pad. The outer trim rail, also known as a rub rail, generally being formed of extruded aluminum and having a shape in cross section of an inverted L. The short leg mounting on the top of the plywood deck and the longer leg engaging the edge of the plywood deck and extending several inches below the lower surface of the deck. The downwardly extending leg typically having reinforcing structure projecting inwardly and along the length of the trim rail. A fence about 26 inches high extends around the deck perimeter and may be offset rearwardly from the bow edge of the deck and forwardly from the stern edge of the deck.

In embodiments, a kicker motor mount for a pontoon boat has a motor receiving unit that is vertically adjustably attached to a deck mount unit. When viewed from above, the motor receiving unit having opposing parallel wall portions defining a box shape with an open top and open bottom. When viewed from above, the deck mount unit having opposing parallel walls defining a box shape with open top and bottom. The deck mount unit having an L-shaped pontoon deck plate with a horizontal deck plate portion extends over the short leg of the trim rail and that attaches to the deck top surface, and a vertical deck plate portion connected at a right angle to the horizontal deck plate portion and that extends down along the trim rail and attaches with a toggle bolt into the trim rail. A pair of upright cantilevered extension plates project rearward from the L-shaped deck plate, each upright extension plate having an L-shaped interface with the deck plate and being welded to the horizontal deck plate portion and also being welded to the vertical deck plate portion. In embodiments, each extension plate having an upper margin that extends upwardly from the horizontal deck plate portion and rearwardly defining a first arcuate curve, and a lower margin that extends rearwardly and downwardly from a lower edge of the vertical deck plate portion defining a second arcuate curve. The upright extension plates extending rearwardly to a rearward attachment portion comprising a bridging plate portion or a pair of flanges. The attachment portion having a height greater than a height of the vertical deck plate portion. A pair of columns of vertically aligned apertures are respectively positioned at a starboard side of the rearward attachment portion and a port side of the rearward attachment portion. A connecting plate portion of the motor receiving unit abuts against the attachment portion of the deck mount unit and has a plurality of holes in selective alignment with the apertures of the pair of columns of vertically aligned apertures providing the vertical adjustability. Fasteners such as bolts and nuts adjoin the connecting portion of the motor receiving unit to the rearward attachment portion of the deck mount unit. The connecting portion can be a bridging plate or a pair of flange portions. A pair of sidewalls extend rearward from the connecting portion of the motor receiving unit to a rearward kicker motor mounting end plate. A clamping block may be positioned within the motor receiving unit at the kicker motor mounting end plate.

A feature and advantage of embodiments is that the kicker mount is securely attached to pontoon boat only at the pontoon deck. The kicker motor mount is secured to the trim rail and to the deck pad and does not rely upon brackets or other attachment structure associated with the pontoon hulls or struts supporting the pontoon hulls.

A feature and advantage of embodiments is the kicker mount is attached using threaded fasteners that do not need cooperating nuts on the threaded ends of the fasteners. In embodiments a minimal number of fasteners are needed to securely attach the kicker motor mount.

A feature and advantage of embodiments is the kicker mount places the kicker motor rearwardly of one of the pontoon hulls of the pontoon boat and is vertically adjustable.

In embodiments, the kicker mount system comprises two cooperating unitary steel box structures cantilevered off of the stern end of pontoon boat deck. From a side view, the two box structures present an S-shape rotated forward ninety degrees. The vertical height of the box shape structures converging toward the stern end of the pontoon boat deck.

In embodiments, cantilevered extension plates have an upwardly extending hump portion extending above an L-shaped welded interface with an L-shaped deck plate, the hump portion and the L-shaped interface effectively strengthening the connection between the extension with the L-shaped deck plate as well as strengthening the L-shaped plate, such that it effectively cannot bend out of the L-shape, and greatly reducing the tension that would be on the vertical weldment between the cantilevered extension plate and the deck plate. The upwardly extending hump portions facilitate a vertical interface with the deck of only the deck thickness defined by the height of the trim rail. A feature and advantage is that the enhanced strength provided by the humped portion between the L-shaped deck plate and the cantilevered extension plates allows the connection of the motor mount to the pontoon boat to be exclusively at the stern end of the deck with a pair of fasteners extending through a vertical portion of the deck plate into the trim rail and only two or four threaded fasteners extending through the horizontal portion of the deck plate into the deck pad.

The above summary is not intended to describe each illustrated embodiment or every implementation of the present disclosure.

DETAILED DESCRIPTION

Figure 1A:
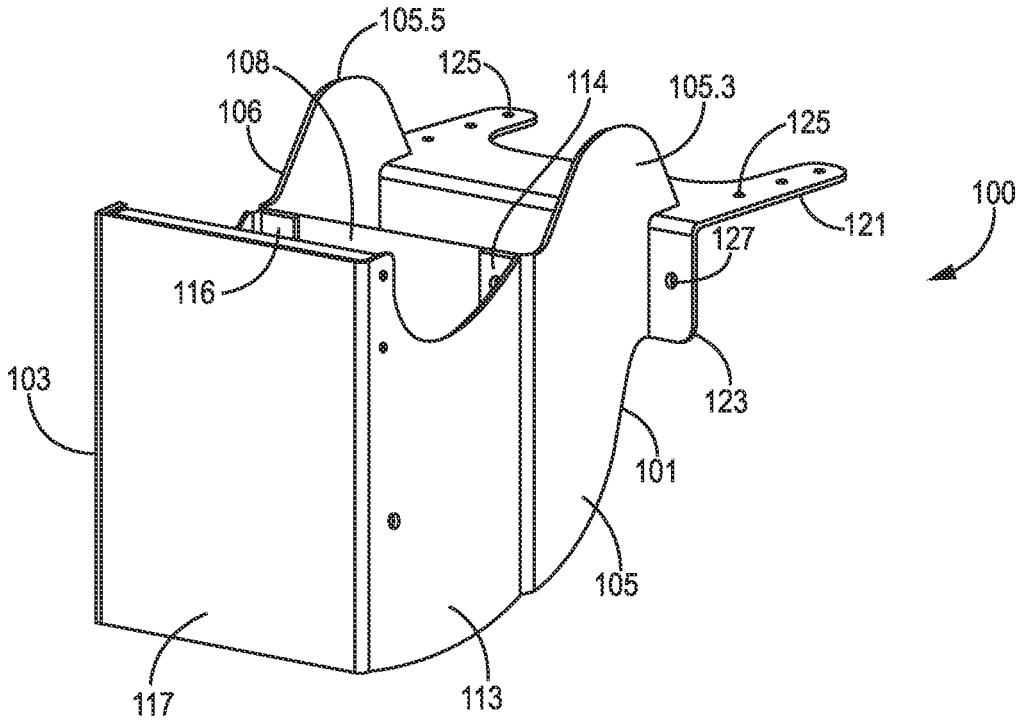
FIG. 1A is a perspective rear view of a pontoon boat kicker mounting system according to an embodiment of the disclosure.
Figure 1B:
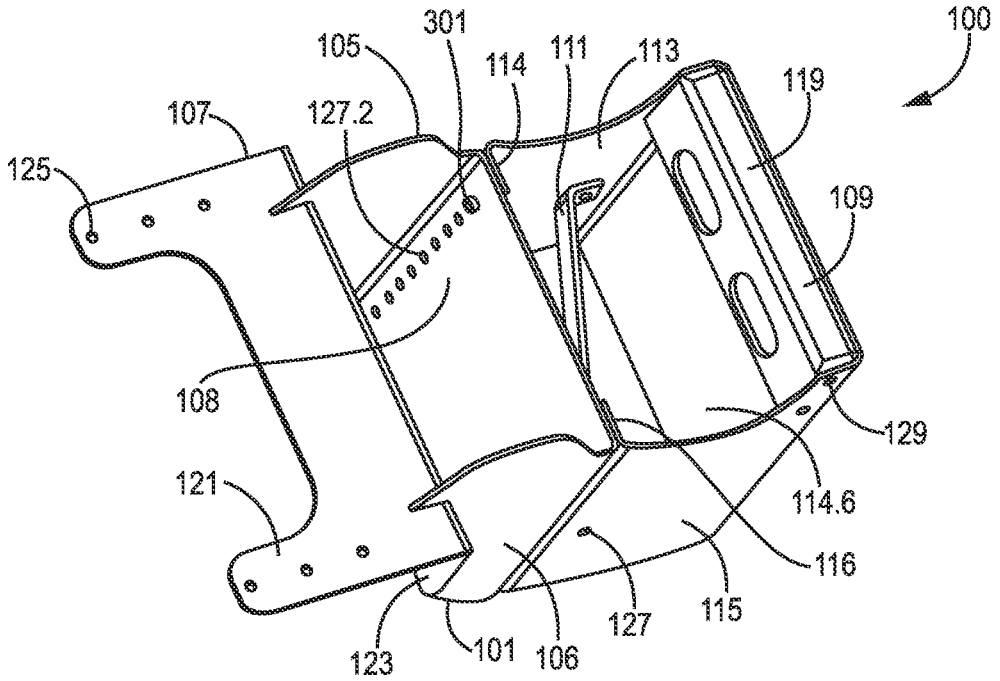
FIG. 1B is a perspective front view of a pontoon boat kicker mounting system according to an embodiment of the disclosure.

Referring to FIGS. 1A-1B, a pontoon boat kicker mounting system 100 is illustrated having a deck mount unit 101 and motor receiving unit 103. Deck mount unit 101 includes upright starboard extension plate 105, port extension plate 106, deck plate 107, and an attachment portion 108 configured as a bridging plate functioning as a backwall of the deck mount unit. In other embodiments, the attachment portion could be a pair of aperture flanges. In embodiments, the deck mount is a unitary unit with deck plate 107, the extension plates 105, 106, and the attachment portion 108 all formed of metal and being integral and/or unitary such as by welding of bending of steel plates.

In embodiments, motor receiving unit 103 has a kicker motor mounting end plate 117 that is unitary with starboard sidewall 113 and port sidewall 115, which connect to and are unitary with connection portion which is illustrated as configured as a pair of apertured flanges 114, 116. Motor receiving unit may be an integral or unitary component with the end plate, sidewall, and connecting portion all welded or formed of bent metal, such as steel or aluminum, plate. Brace 111 may be added within an interior cavity 114.6 spanning between starboard sidewall 113 and port sidewall 115 for rigidifying the box structure.

In embodiments, clamping block 109 also fits within motor receiving unit 103. Clamping block 109 is rectangular block and is positioned such that a back surface is generally flush with back wall 117, side surfaces are generally flush with starboard and port sidewalls 113, 115 and top surface 119 is generally flush with a top edge of motor receiving unit 103.

As best seen in FIG. 1A, when viewed from above, the kicker mount system deck mount unit 101 is configured as a box with an open top and open bottom.

Figure 2C:
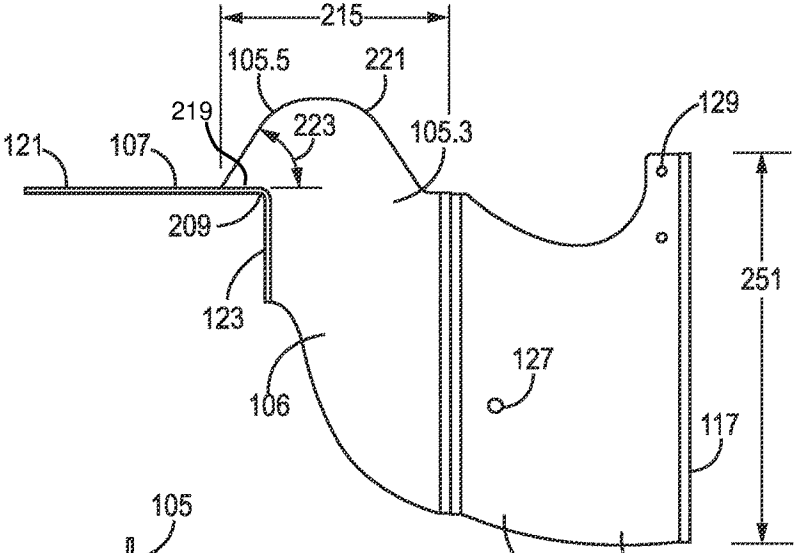
FIG. 2C is a side view of a pontoon boat kicker mounting system according to an embodiment of the disclosure.
Figure 2B:
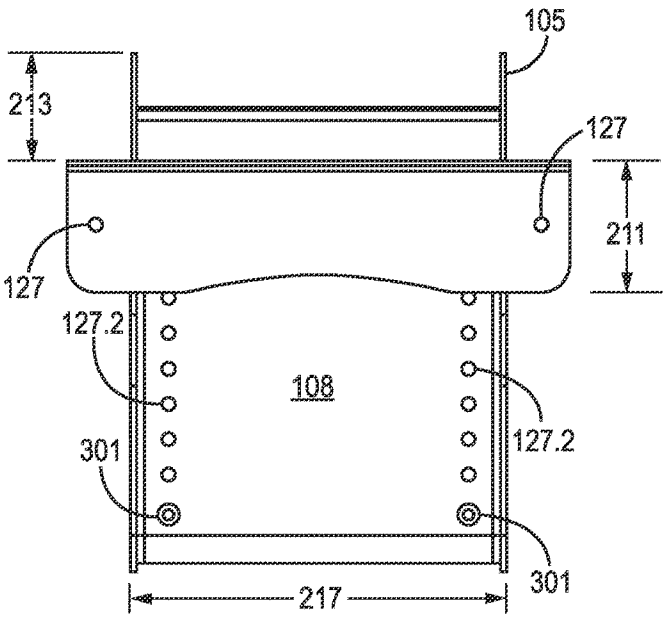
FIG. 2B is a front view of a pontoon boat kicker mounting system according to an embodiment of the disclosure.
Figure 2A:
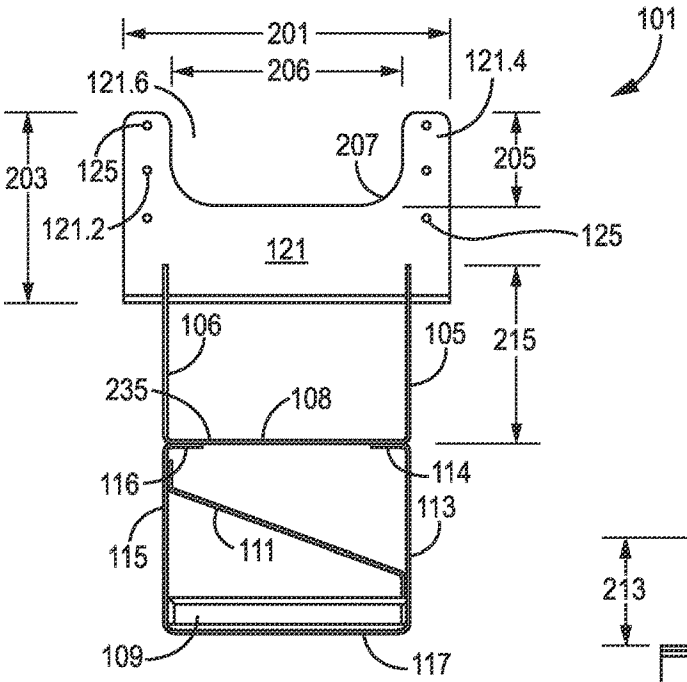
FIG. 2A is a top view of a pontoon boat kicker mounting system according to an embodiment of the disclosure.

Referring to FIGS. 2A-2C, deck plate 107 has an L-shaped profile with horizontal deck plate portion or long leg 121 and vertical deck plate portion or short leg 123. As shown in FIG. 2A, long leg 121, when viewed from above, is generally U-shaped with mounting apertures 125 along the forward extending side finger portions 121.2, 121.4. In embodiments, the forward extending side finger portions of the long leg 121 define a recess 121.6. When mounted, long leg 121 extends along the deck of a pontoon boat and may protrude into areas accessed by users, for example under a pontoon fence. Minimizing material in these areas is advantageous to avoid tripping or other injury. Each side portion of long leg 121 may have one or more mounting apertures 125. While using only two or four apertures may be sufficient for securing long leg 121 to the deck of a pontoon boat, there may be obstacles impeding access to mounting apertures 125 on some boats. Offering a plurality of mounting apertures 125 ensures there will be enough exposed mounting apertures 125 to securely fasten long leg 121 to the deck of a pontoon boat.

In embodiments, long leg 121 has a width 201 between 10 and 24 inches. In embodiments, width 201 is about 14 inches. In embodiments, long leg 121 has a length 203 between 4 and 16 inches. In embodiments, length 203 is about 8 inches. In embodiments, the cut away portion of long leg 121 has a length 205 of about four inches and a width 206 of about ten inches. In embodiments, the cut away portion of long leg 121 has a radius 207 of about 2 inches. It is preferable that where users come into contact with components of the pontoon boat kicker mounting system, that those components are scrubbed of burrs and sharp edges are removed such as by rounding corners or beveling edges. In embodiments, mounting apertures 125 have a diameter of about 0.31 inches. In embodiments, mounting apertures 125 are about twelve inches from center to center. In embodiments, mounting apertures 125 are about one inch from the nearest side edge of long leg 121. In embodiments, mounting apertures 125 are less than one inch from a forward edge of long leg 121. In embodiments, long leg 121 has six mounting apertures 125. In embodiments, long leg 121 has four to ten mounting apertures 125.

Referring to FIGS. 1A to 2C, in embodiments, short leg 123 of deck plate 107 has a height 211 between two and six inches. In embodiments, short leg 123 has a height of about 3.688 inches. Short leg 123 and long leg 121 meet at radius 209. Deck plate 107 is generally configured such that when long leg 121 is mounted on the deck of a pontoon boat, short leg 123 abuts the trim rail of the pontoon boat. In embodiments, radius 209 is about 0.178 inches. In embodiments, short leg 123 has a plurality of bolt holes 127. In embodiments, short leg 123 has two bolt holes 127. In embodiments, bolt holes 127 may be about 12.5 inches from center to center. In embodiments, bolt holes 127 have a larger diameter than mounting apertures 125. In embodiments, bolt holes 127 have a diameter of about 0.41 inches.

As depicted in the top view in FIG. 2A, the pontoon deck mount unit port and starboard extension plates 105, 106 have a length 215 between five and eight inches. In embodiments, port and starboard extension plates 105, 106 have a length 215 of 7.5 inches. In embodiments, attachment portion configured as a back wall 108 has a width 217 between five and fifteen inches. In embodiments, width 217 is about 10.5 inches. The attachment portion, back wall 108 has a plurality of holes 127.2 for threaded fasteners 301 to connect the deck mount unit 101 and the motor mount unit.

An upper portion of extension plates 105, 106 are unitary with deck plate 107. Extension plates 105 have a hump portion 105.3 that extends upwardly above deck plate 107 with a height 213 between two and six inches. In embodiments, height 213 is about three inches. In embodiments, a top margin 105.5 of extension plates has a curved profile with a radius 221 between 1.5 and 2.5 inches on either side of the peak. In embodiments, radius 221 is about two inches. In embodiments, extension plate 105 forms an angle 223 with long leg 121 between forty and eighty degrees. In embodiments, angle 223 is about sixty degrees. Upper hump portion 105.3 of extension plate 105 extends over long leg 121 of deck plate 107. In embodiments, the overlap length 219 is between one and three inches. In embodiments, the bolt holes 125, 127 of the deck plate are positioned laterally exterior with respect to the starboard and port extension plates 105, 106. Accordingly, bolt holes 127 remain easily accessible to a user for securing deck plate 107 to a pontoon boat. Deck plate 107 is fixedly attached to extension plates 105. A fixed attachment includes any attachment means that is permanent in nature such that separating the components would cause damage to one or more of the components. For example, in embodiments, deck plate 107 is welded to extension plate 105. Having a portion of extension plate 105 extend vertically above deck plate 107 redirects forces exerted on deck plate 107 when a kicker motor is mounted. Accordingly, this redirection of forces permits deck plate 107 to be secured to a pontoon boat with fewer fasteners and without extensive bracing along the sides of a pontoon hull or the underside of the boat. The arcuate profile may be varied for aesthetic or other purposes. For example, the profile may be altered to be more rectangular than arcuate without impacting the ability to reduce fasteners and eliminate additional bracing. Similarly, dimensions disclosed may be varied to accommodate larger or smaller kicker motors.

Motor receiving unit 103 is generally configured as a box, with port sidewall 113, starboard sidewall 115, end plate 117, and connection portion. Connection portion is configured as a pair of mounting flanges 114, 116, adjoining port sidewall 113, and starboard wall 115 respectively. Each mounting flange 114, 116 includes a plurality of bolt holes 127.4 corresponding to bolt holes 127.2 in rear wall 108 of the deck mount unit 101. In embodiments, mounting flanges 114, 116 have a height equivalent to the height of rear wall 108 connection to extension plates 105, 106. In embodiments, back wall 117 of motor receiving unit 103 has a height 251 between eight and sixteen inches. In embodiments, back wall 117 is taller than mounting flanges 114, 116. In embodiments, height 251 is about 12.75 inches. In embodiments, a top edge of starboard and port walls 113, 115 has an arcuate profile. The profile may have a larger radius towards mounting flanges 114, 116 and a smaller radius towards rear wall 117. A top portion of motor receiving unit may be configured to retain clamping block 109. Clamping block may be positioned such that it is simultaneously flush with rear wall 117 and the top portions of port and starboard walls, 113, 115. Clamping block may be formed of a block of polymer, wood, composite, or other materials. The top portion of motor receiving unit 103 further includes a plurality of thru holes 129 aligned with clamping block 109. In embodiments, thru holes 129 have a diameter of about 0.28 inches. In embodiments, each of starboard and port walls 113, 115 have two thru holes 129. Fasteners inserted through thru holes 129 may retain clamping block 109 in place. It will be appreciated by those in the art that the raised top portion of motor receiving unit 103 along with the arcuate top edge of port and starboard walls 113, 115 provide a user easier access to clamping block 109. Easy access to clamping block 109 facilitates securing a kicker motor to the pontoon boat kicker mounting system as will be discussed below. To minimize shearing forces, one or more cross bars 111 may be mounted between starboard and port walls 113, 115. Bolt holes 127 in starboard and port walls 113, 115 provide mounting locations for cross bars 111. In embodiments, a single cross bar 111 may be mounted diagonally. For example, a first end of cross bar 111 might be mounted on starboard wall 115 near mounting flange 116 and the opposite end of cross bar 111 might be mounted on port wall 113 near to rear wall 117. In embodiments, two or more cross bars 111 may be mounted in a variety of patterns. For example, two cross bars 111 might be mounted in parallel with one another and parallel to rear wall 117.

Figure 3:
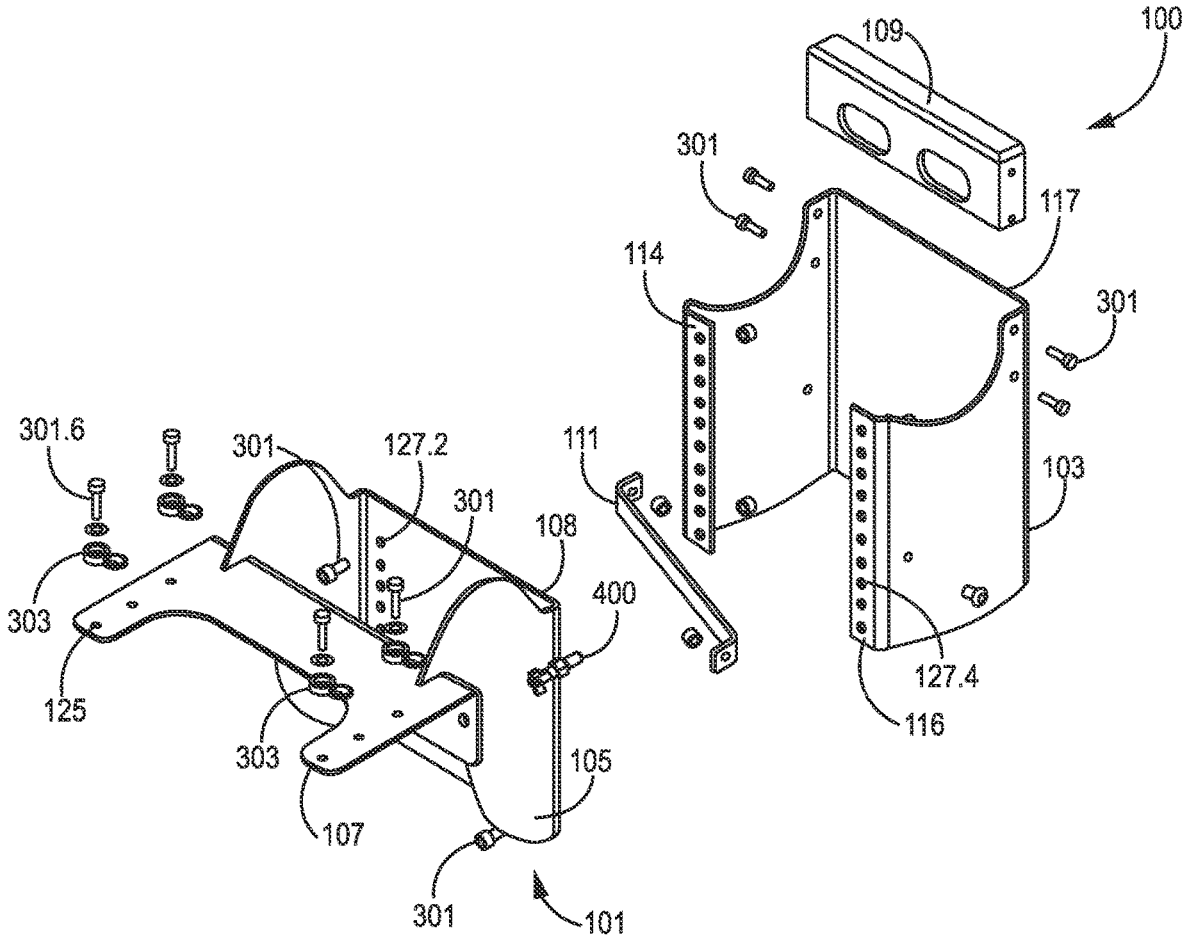
FIG. 3 is an exploded perspective view of a pontoon boat kicker mounting system including exemplary fasteners according to an embodiment of the disclosure.

Referring to FIG. 3, an exemplary pontoon boat kicker mounting system 100 is shown in an exploded view along with exemplary fasteners 301. Fasteners 301 may releasably couple components to one another or to a pontoon boat. For example, fasteners 301 may include screws, socket head screws, flat head screws, bolts, lag bolts, or other similar devices as known to one skilled in the art. In some instances where a user may come into contact with a fastener 301, such as fasteners 301 used on the decking of a pontoon boat, a portion of fastener 301 that might otherwise be exposed can be hidden. For example, using a hinged fastener cap 303 could prevent a user from injuring their foot or toes on the head of an exposed fastener 301.

Bolt holes 127 in rear wall 235 of extension plate 105 generally correspond to bolt holes 127 in mounting flanges 114, 116 of motor receiving unit 103. As seen in the side view shown in FIG. 2C, a pontoon boat kicker mount system 100 may be assembled such that top and bottom edges of rear wall 235 and mounting flanges 114, 116 are generally flush. However, it may be desirable to vertically offset extension plate 105 and motor receiving unit 103. As extension plate 105 is fixed relative to the pontoon boat, raising or lowering motor receiving unit 103 will in turn raise or lower a mounted kicker motor relative to a pontoon boat and the water. For example, a larger kicker motor may require raising motor receiving unit 103 whereas a smaller kicker motor may require lowering motor receiving unit 103 to ensure the propellers of a kicker motor are at the desired depth in a body of water.

Figure 4A:
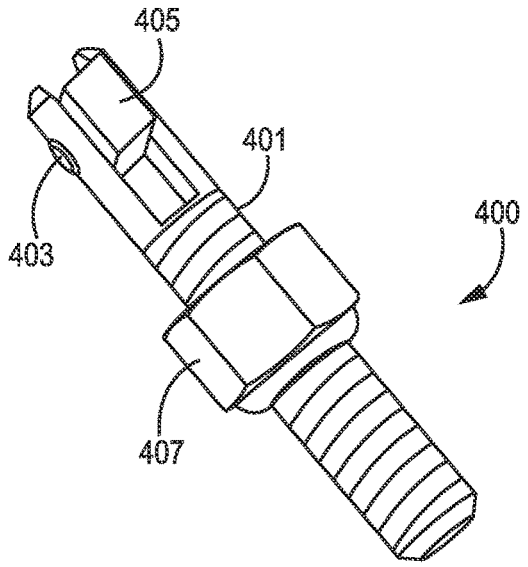
FIG. 4A is a perspective view of a toggle bolt fastener for a pontoon boat kicker mounting system according to an embodiment of the disclosure.
Figure 4B:
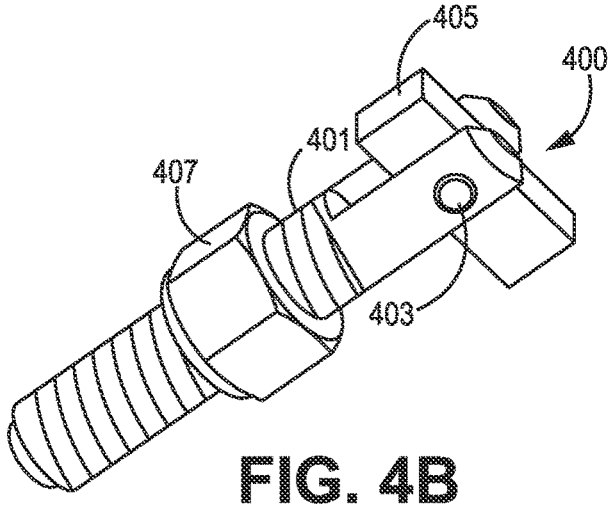
FIG. 4B is a perspective view of a toggle bolt fastener for a pontoon boat kicker mounting system according to an embodiment of the disclosure.
Figure 4C:
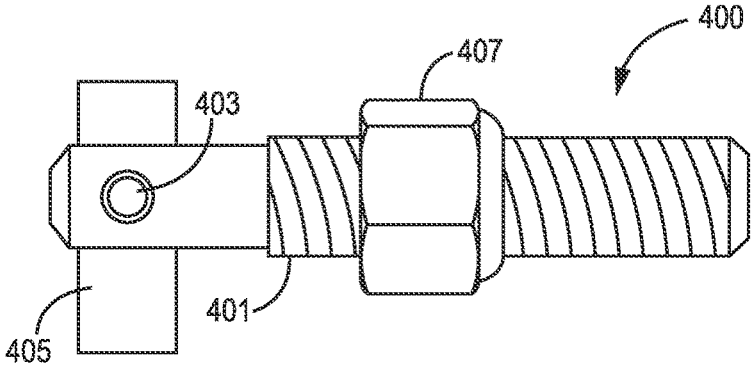
FIG. 4C is a side view of a toggle bolt fastener for a pontoon boat kicker mounting system according to an embodiment of the disclosure.

FIGS. 4A-4B illustrate a toggle bolt 401 that can secure deck plate 107 to a trim rail of a deck of a pontoon boat without the need for additional bracing, getting underneath the boat, or accessing tight spaces with tools. Toggle bolt 400 has a bolt body 401 having a threaded shaft and notched on an opposite end. The notched portion has through apertures to receive pin 403. Swivel anchor 405 is sized to fit within the notched portion of bolt body 401. Swivel anchor is rotatably mounted to bolt body 401 with pin 403 acting as a pivot point such that a portion of swivel anchor 405 is captured within the notched portion. In embodiments, swivel anchor 405 is mounted off-center such that one end of swivel anchor 405 is stopped by bolt body 401 before passing through the notched portion, thereby limiting swivel anchor 405 to a rotation of less than 360 degrees. Swivel anchor 405 can be oriented such that it is able to pass through bolt hole 127 and a corresponding hole in the trim rail of the deck of a pontoon boat. Swivel anchor 405 can then flip open and be secured in place by threading nut 407 onto bolt body 401. Accordingly, deck plate 107 will be sandwiched between swivel anchor 405 and nut 407 and firmly held in place.

Figure 5:
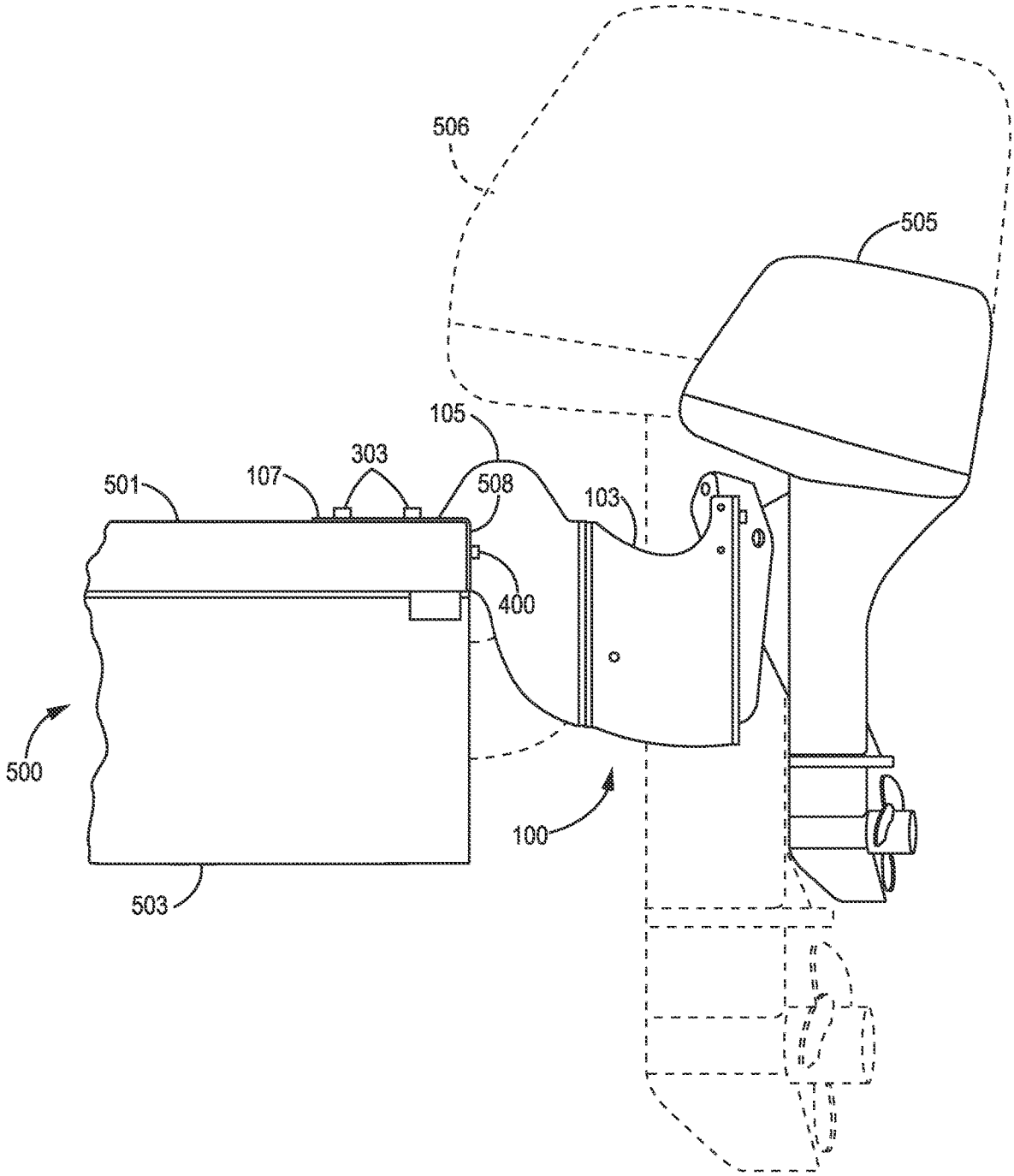
FIG. 5 is a side view of a pontoon boat kicker mounting system with a deck mounting plate secured to a pontoon boat and a kicker motor secured to the pontoon boat kicker mounting system.
Figure 6A:
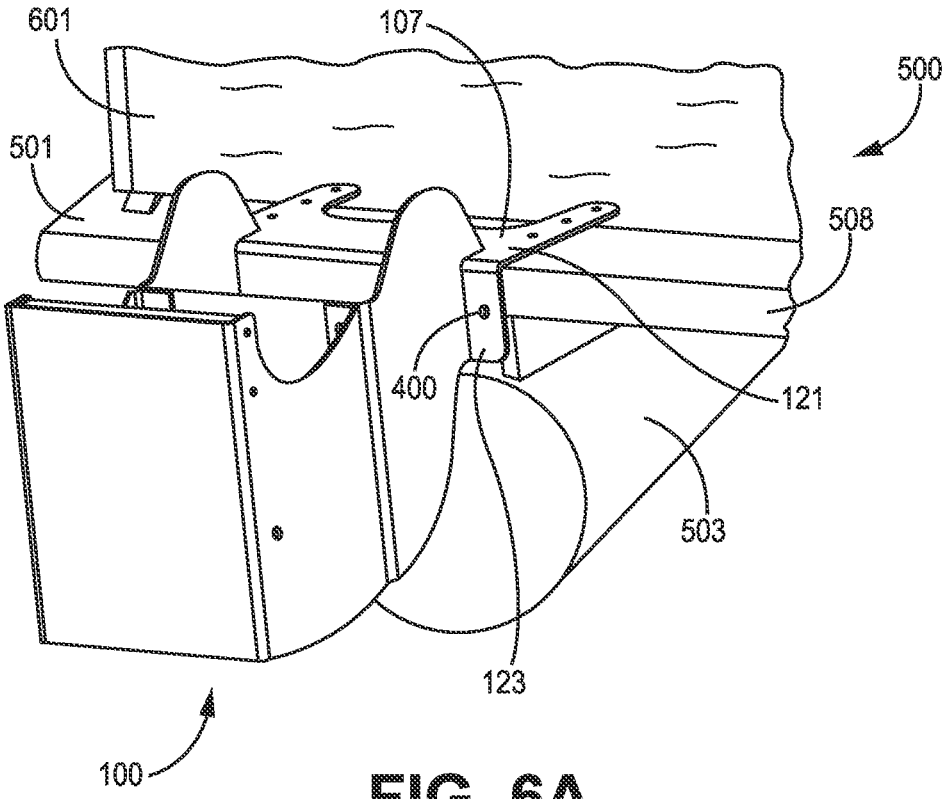
FIG. 6A is a perspective view of a pontoon boat kicker mounting system mounted to a pontoon boat with a portion of the deck plate slid under a fence on the deck of the pontoon boat.

Referring to FIGS. 5 and 6A, a side view and rear perspective views of a pontoon boat kicker mounting system 100 is shown with deck plate 107 mounted to a deck 501 of a pontoon boat 500 without utilizing, engaging or contacting pontoon hull structures 503. Outboard kicker motor 505 is secured to the kicker mount system 100. The main pontoon motor 506 is illustrated by dashed lines is attached to the pontoon transom, not shown in this view. Hinged fastener caps 303 help protect users on deck 501 from being injured by fasteners. Toggle bolt 400 secures deck plate 107 to the deck by way of the trim rail 503 of the deck 501. FIG. 6 illustrates a portion of long leg 121 passes underneath a fence 601 secured to the deck 501 of the pontoon boat.

Figure 6B:
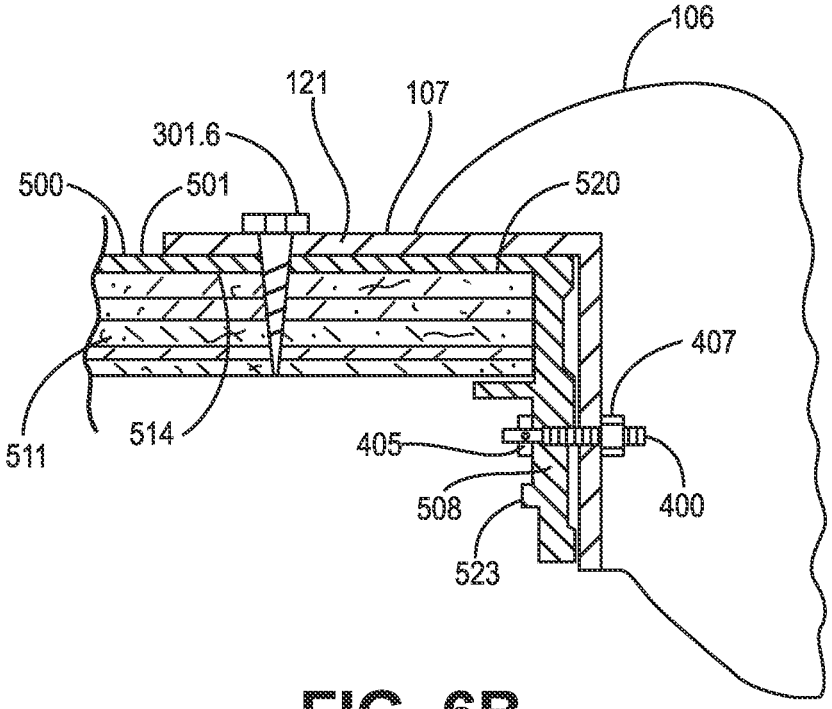
FIG. 6B is a cross section of the interface between the pontoon boat kicker mounting system and the deck of a pontoon boat.

Referring to FIG. 6B, a cross section of the connection between the pontoon boat 500 and the kicker mount system. The pontoon boat deck 501 comprises a deck pad 511 which is typically plywood, and the trim rail 508 that extends around the periphery of the deck. The trim rail is typically an aluminum strip having an L-shape as illustrated and extends over the top surface 520 of the plywood deck pad securely attached to the deck pad. The deck pad is typically covered such as by carpet or other covering 514. The deck plate is secured to the deck by the screw 301.6 extending through a hole in the horizontal deck plate portion 121 into the plywood deck pad, and by the toggle bolt body 401 and nut 407. The swivel anchor 405 is engaged with the inside surface 523 of the trim rail 508

Deck plate 107, extension plate 105, motor receiving unit 103, and brace 111 may be made of any durable materials. For example, deck plate 107, extension plate 105, motor receiving unit 103, and brace 111 may be made of metal or sheet metal. In embodiments, deck plate 107, extension plate 105, motor receiving unit 103, and brace 111 may be made from 10 gauge steel. While steel or other metals are highly durable, they are susceptible to rust and wear from being used in the water. Accordingly, in embodiments, the metal is coated. For example, the metal be powder coated. In embodiments, metal components may be ceramic coated.

Figure 7:
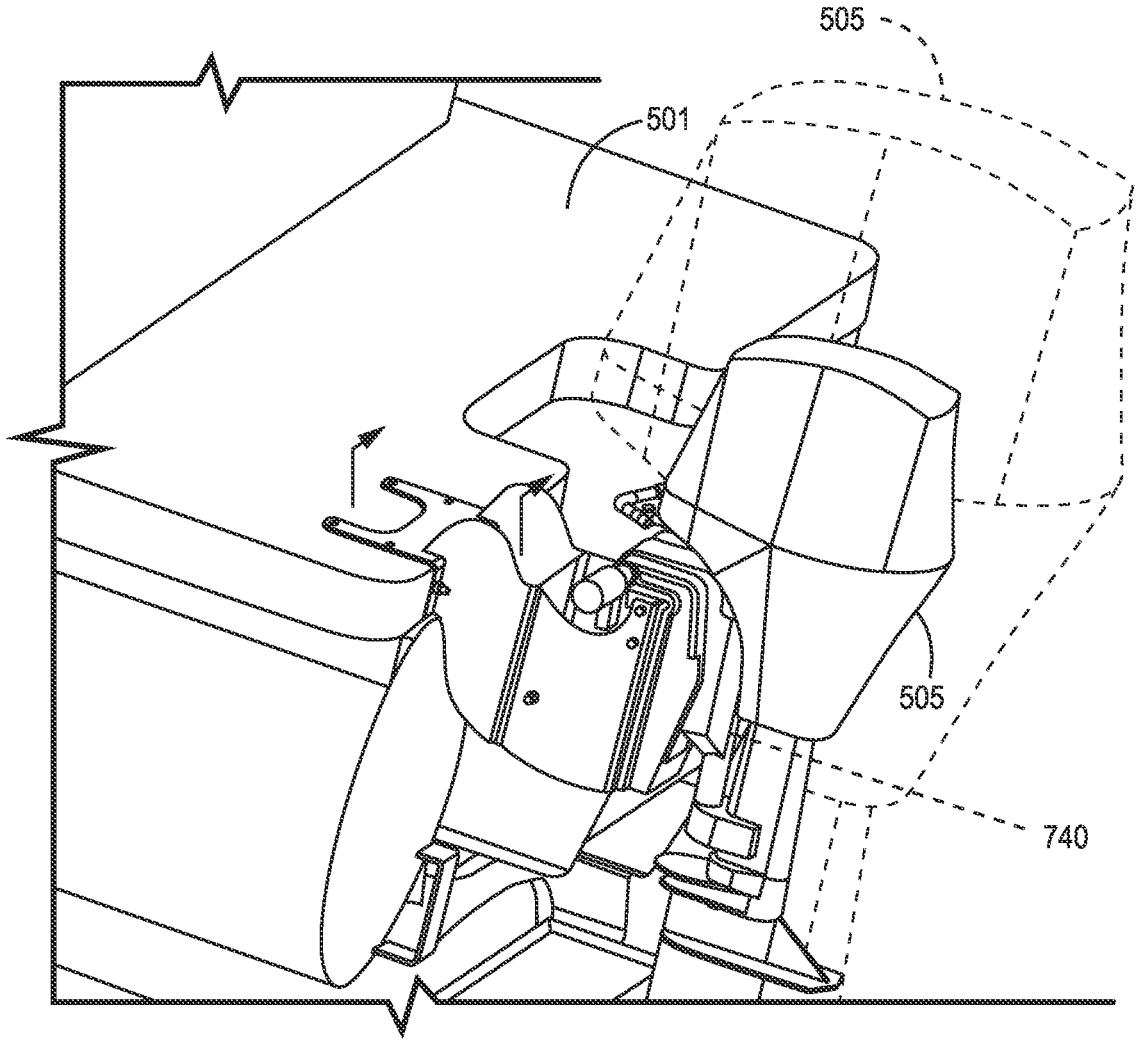
FIG. 7 is a perspective side view of a pontoon boat kicker mounting system with a deck mounting plate secured to a pontoon boat and a kicker motor secured to the pontoon boat kicker mounting system.
Figure 8:
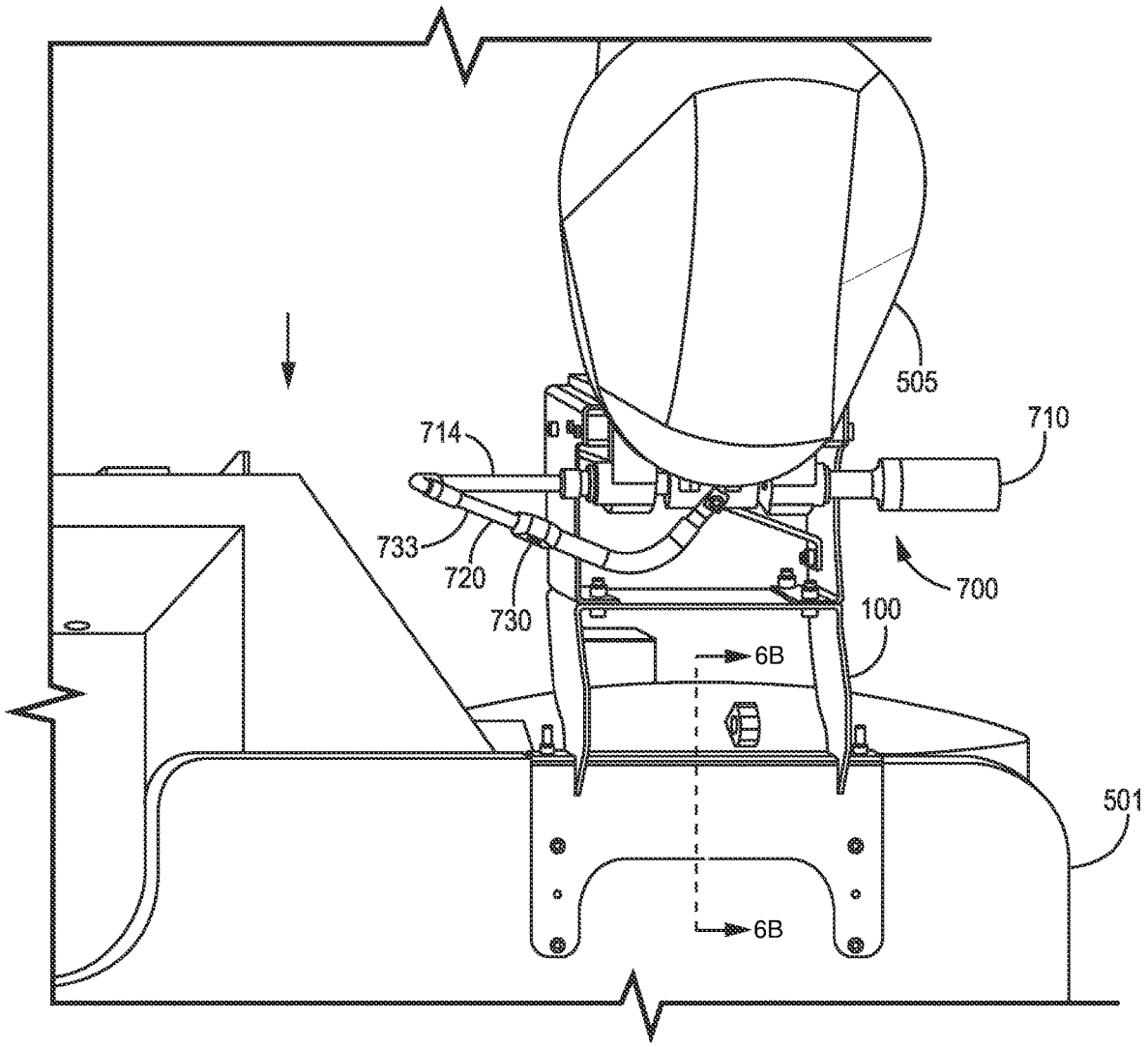
FIG. 8 is a perspective top view of a pontoon boat kicker mounting system with a deck mounting plate secured to a pontoon boat and a kicker motor secured to the pontoon boat kicker mounting system.

FIGS. 7 and 8 are perspective views of the kicker mount system 100 secured to the deck 501 of a pontoon boat 500 and the kicker motor 505 is secured to the kicker mount system 100. A remote steering unit 700 comprises an electric motor 710, an extendable and retractable shaft 714 pivotally connected to a tubular J-bar 720 that has an adjustable length provided by the nut 730 that tightens onto the telescoping shaft 733. The J-bar pivotally connects to the motor which has a pivot 740 with a vertical or upright axis allowing the motor to rotate about the axis. The arcuate top edge of the port and starboard walls of the motor receiving unit provides additional clearance for remote steering unit 700.

The following patents are incorporated by reference for all purposes: U.S. Pat. Nos. 9,022,342; 9,598,159; 8,535,105; 5,782,662; 8,657,637.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

I claim:

1. A kicker motor mount system for attachment to only the deck of a pontoon boat, the deck having a deck pad and a trim rail, the kicker motor mount system comprising:

a deck mount unit having an L-shaped deck plate and an attachment plate, the deck plate having a horizontal deck plate portion with apertures for receiving threaded fasteners, a vertical plate portion extending downwardly from the horizontal deck portion no more than 6 inches and having a pair of apertures for receiving a toggle fastener, the pair of apertures within 4 inches of the horizontal plate portion;

a kicker motor receiving unit attached to the deck mount unit and adjustable vertically thereto, wherein the kicker motor receiving unit comprises a pair of flanges abutting the deck mount unit, and wherein the flanges of the kicker motor receiving unit and a rear wall of the deck mount unit have corresponding apertures, the corresponding apertures configured to receive threaded fasteners such that a vertical offset between the kicker motor receiving unit and the deck mount unit may be adjusted.

2. The kicker motor mount system of claim 1, wherein the deck mount unit comprises a pair of toggle fasteners, and wherein each of the toggle fasteners comprises a swivel anchor configured to pivot from an insertion position to an anchored position and a bolt body such that in the anchored position the swivel anchor is generally perpendicular to the bolt body and in the insertion position the swivel anchor is generally axially aligned with the bolt body.

3. The kicker motor mount system of claim 2, wherein each of the toggle fasteners comprises a pin about which the swivel anchor rotates, and the bolt body having a notched end through which at least a portion of the swivel anchor may pass.

4. The kicker motor mount system of claim 3, wherein the swivel anchor is mounted to the pin off-center such that the swivel anchor may rotate more than 90 degrees but less than 360 degrees about the pin.

5. The kicker motor mount system of claim 1, wherein the deck mount unit extends upwardly from the deck between 2 and 6 inches.

6. The kicker motor mount system of claim 5, wherein an upwardly extending portion of the deck mount unit has an arcuate profile.

7. The kicker motor mount system of claim 1, wherein the kicker motor receiving unit comprises one or more support braces, the one or more support braces extending from a port sidewall to a starboard sidewall.

8. The kicker motor mount system of claim 1, wherein the kicker motor receiving unit comprises a mounting block.

9. A kicker motor mount system for attachment to only the deck of a pontoon boat, the deck having a deck pad and a trim rail, the kicker motor mount system comprising:

a deck mount unit having an L-shaped deck plate and an attachment plate, the deck plate having a horizontal deck plate portion with apertures for receiving threaded fasteners, a vertical deck plate portion extending downwardly from the horizontal deck portion;

a pair of extension plates unitary with and extending rearwardly from the L-shaped deck plate, each extension plate having a forward hump portion extending over and being unitary with the horizontal deck plate portion and a portion unitary with the vertical deck plate portion;

a kicker motor receiving plate connecting to and rearward of the pair of extension plates attached to the deck mount unit and adjustable vertically thereto.

10. The kicker motor mount system of claim 8, wherein the extension plates extend downwardly and arcuately from the vertical deck plate portion.

11. The kicker motor mount system of claim 9, wherein the kicker motor receiving plate comprises a port sidewall and a starboard sidewall, the sidewalls further comprising flanges abutting the extension plates.

12. The kicker motor mount system of claim 11, wherein the sidewalls have a top edge, the top edge having a profile with a depressed portion and a raised portion.

13. The kicker motor mount system of claim 12, wherein a mounting block is secured within the raised portion of the sidewalls.

14. A method of installing a kicker motor mount system for attachment to only the deck of a pontoon boat, the deck having a deck pad and a trim rail, the method comprising:

providing a deck mount unit having an L-shaped deck plate and an attachment plate, the deck plate having a horizontal deck plate portion with apertures for receiving threaded fasteners, a vertical deck plate portion extending downwardly from the horizontal deck portion no more than 6 inches and having a pair of apertures for receiving a pair of toggle fasteners, the pair of aperture within 4 inches of the horizontal plate portion, a pair of toggle fasteners; and attaching the vertical deck plate to the deck by toggle fasteners extending through the vertical plate portion and into the trim rail.

15. The method of claim 14, further comprising:

orienting a swivel anchor of the toggle fastener such that it is axially aligned with a threaded shaft of the toggle fastener; and passing the swivel anchor and a portion of the body of the toggle fastener through the deck plate and the trim rail such that the swivel anchor is entirely forward of the trim rail and the threaded shaft extends rearwardly from the deck plate.

16. The method of claim 15, further comprising:

pulling the toggle fastener such that the swivel anchor is generally perpendicular to the body of the toggle fastener and flush with the trim rail; and threading a nut onto the rearwardly extending threaded shaft of the toggle fastener thereby securely fastening the vertical plate portion to the trim rail.

17. The method of claim 14, further comprising:

fastening the horizontal deck plate portion to the deck pad with at least two screws.

18. The method of claim 17, further comprising:

covering exposed portions of the at least two screws with protective caps.

* * * * *